United States Patent [19]

Ishikawa et al.

[11] Patent Number: 4,558,685

[45] Date of Patent: Dec. 17, 1985

[54] ENGINE IGNITION DEVICE

[75] Inventors: Yasuki Ishikawa, Orlando, Fla.; Masazumi Sone, Tokyo; Akio Kawai, Yokohama, both of Japan

[73] Assignee: Nissan Motor Co., Ltd., Yokohama, Japan

[21] Appl. No.: 596,794

[22] Filed: Apr. 4, 1984

[30] Foreign Application Priority Data

Apr. 4, 1983 [JP] Japan ..... 58-57792

[51] Int. Cl.[4] ..... F02P 1/00

[52] U.S. Cl. ..... 123/620; 123/640

[58] Field of Search ..... 123/620, 621, 640

[56] References Cited

U.S. PATENT DOCUMENTS

| | | | |
|---|---|---|---|
| 4,349,008 | 9/1982 | Wainwright | 123/620 |
| 4,369,757 | 1/1983 | Anzai | 123/620 |
| 4,393,850 | 7/1983 | Nishida | 123/620 |
| 4,407,259 | 10/1983 | Abo | 123/620 |
| 4,409,952 | 10/1983 | Canup | 123/620 |
| 4,462,380 | 7/1984 | Asik | 123/620 |

*Primary Examiner*—Ronald B. Cox

*Attorney, Agent, or Firm*—Schwartz, Jeffery, Schwaab, Mack, Blumenthal & Evans

[57] ABSTRACT

There is provided an engine ignition device which generates a high voltage in the secondary windings of the ignition coil through switching on and off of the electric current flowing in the primary windings by means of an ignition circuit. The generated high voltage is impressed on the ignition plugs to initiate ignition, and, at the same time, the high voltage is boosted by a DC-DC converter connected to the secondary windings and is supplied continuously to the ignition plugs, to prolong the discharge duration. There is further provided a DC-DC converter controlling circuit to control the DC-DC converter to initiate ignition synchronous with the ignition signal output and also to reduce the operating time of the DC-DC converter as the engine increases its speed.

4 Claims, 5 Drawing Figures

ENGINE IGNITION DEVICE

BACKGROUND OF THE INVENTION

1. Field of the Invention

The present invention relates to an ignition device equipped with a DC-DC converter, more particularly, to an ignition device with the capability of controlling the operating time of a DC-DC converter.

2. Description of the Prior Art

An example of conventional ignition devices is shown in FIG. 1. In this ignition device 2, the output of a crank angle sensor 4, which generater power at about the ignition time in synchronism with the engine rotation, is input to a transistor ignition circuit 6. The ignition circuit 6, in synchronism with the engine rotation intermittently releases electric current $I_1$ to the primary windings $L_1$ of an ignition coil 8, generating a high tension pulse $V_p$ of 15 kV in the secondary windings. The high tension pulse $V_p$ is input to a distributor 10 whose center electrode r rotates synchronously with the engine rotation, whereby through a plurality of output terminals of the distributor and via high tension cords 12*a*–12*d* it is impressed to prescribed ignition plugs 14*a*–14*d* in prescribed order, to generate discharges in the ignition plugs 14*a*–14*d*. The output of the DC-DC converter which boosts the 12 V of a battery 16 to a high voltage of −2 kV is continuously supplied to the low voltage side of the secondary windings $L_2$ of the ignition coil 8. Therefore, when the ignition plug 14*a* installed on the first cylinder starts to discharge due to the high tension pulse $V_p$, and thus turns the ignition plug 14*a* electrically conductive, the high voltage of −2 kV is supplied to the ignition plug 14*a* via the secondary windings $L_2$ through the route of the distributor 10, the high tension cord 12*a*, and the ignition plug 14*a*. In this way, by supplying a high voltage of −2 kV from the DC-DC converter to the ignition plugs 14*a*–14*d* which started to discharge under the high tension pulse $V_p$, and finding themselves in the electrically conductive state, the duration of discharges at the ignition plugs can be maintained at more than twice the discharge duration (usually 1–2 ms) due to electromagnetic induction energy supplied by the ignition coil 8. Namely, by raising the discharge energy to a high level (in excess of 100 mJ) which is over twice the corresponding energy for an ignition device not equipped with the DC-DC converter, an improvement in the fuel consumption is achieved through stable and sure ignition and combustion for engines, even under unfavorable combustion conditions.

However, ignition devices equipped with the conventional DC-DC converter are constructed in such a way as to have the DC-DC converter operational all the time so that the DC-DC converter will be operating even prior to the start of ignition and until the latter period of combustion where the combustion improvement measures have no effect, depending upon the speed of engine rotation, and as a result, power is consumed wastefully, aggravating in this respect the fuel consumption. In addition, as a consequence of unnecessarily prolonged discharge times, a deterioration in the durability of the device results due to increased consumption of ignition plug electrodes and to increased heating of the DC-DC converter, ignition coil, and so forth. Moreover, because of the high voltages impressed on the ignition plugs since the time prior to the ignition start, there remain troubles such as the engine malfunctioning due to occurrence of discharges at irregular times other than the prescribed ignition times.

SUMMARY OF THE INVENTION

It is an object of the present invention to provide an engine ignition device which improves the stability of engine operation.

It is another object of the present invention to provide an engine ignition device which suppresses power consumption without impairing the ignition and combustion performances of the engine.

It is a further object of the present invention to provide an engine ignition device which improves the fuel consumption.

It is a further object of the present invention to provide an engine ignition device which suppresses the consumption of the ignition plug electrodes.

It is a further object of the present invention to provide an engine ignition device which improves the durability of the DC-DC converter and ignition coil by reducing the amount of heat generated in them.

It is a further object of the present invention to provide an engine ignition device which prevent irregular discharges.

It is a further object of the present invention to provide an engine ignition device which eliminates undesirable aspects of the conventional devices described in the above.

Briefly described, these and other objects of the present invention are accomplished by the provision of an improved engine ignition device which includes a DC-DC converter that supplies a high voltage to the ignition plugs on continuous basis to lengthen the duration of discharges, and a DC-DC converter controlling circuit that controls the DC-DC converter so as to initiate the operation at the same time as the arrival of the ignition signal from the ignition circuit and also to reduce the operating time of the DC-DC converter in accordance with the speed of engine rotation.

BRIEF DESCRIPTION OF THE DRAWING

These and other objects, features, and advantages of the present invention will be more apparent from the following description of a preferred embodiment, taken in conjunction with the accompanying drawings, in which.

DESCRIPTION OF THE PREFERRED EMBODIMENTS

Figure 1:
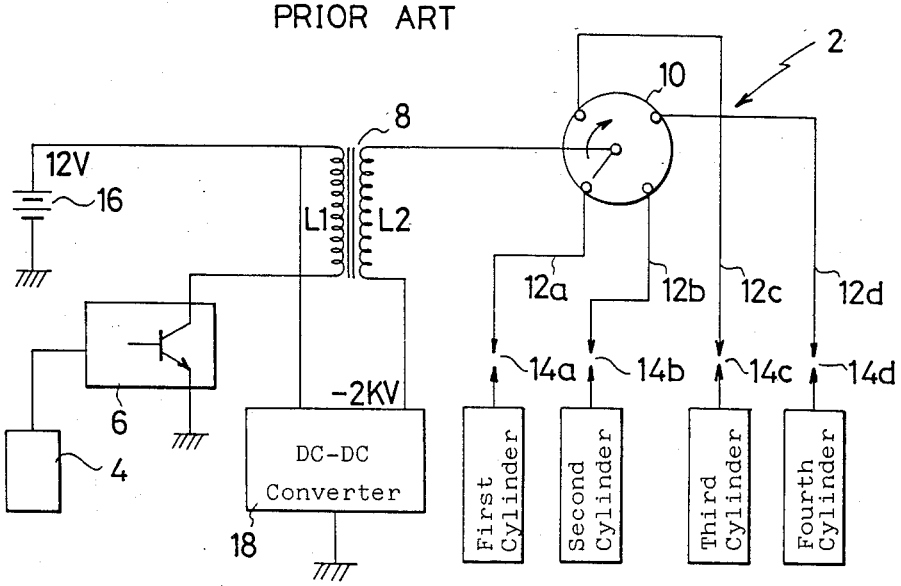
FIG. 1 PRIOR ART
FIG. 1 is a block circuit diagram of a conventional engine ignition device.
Figure 2:
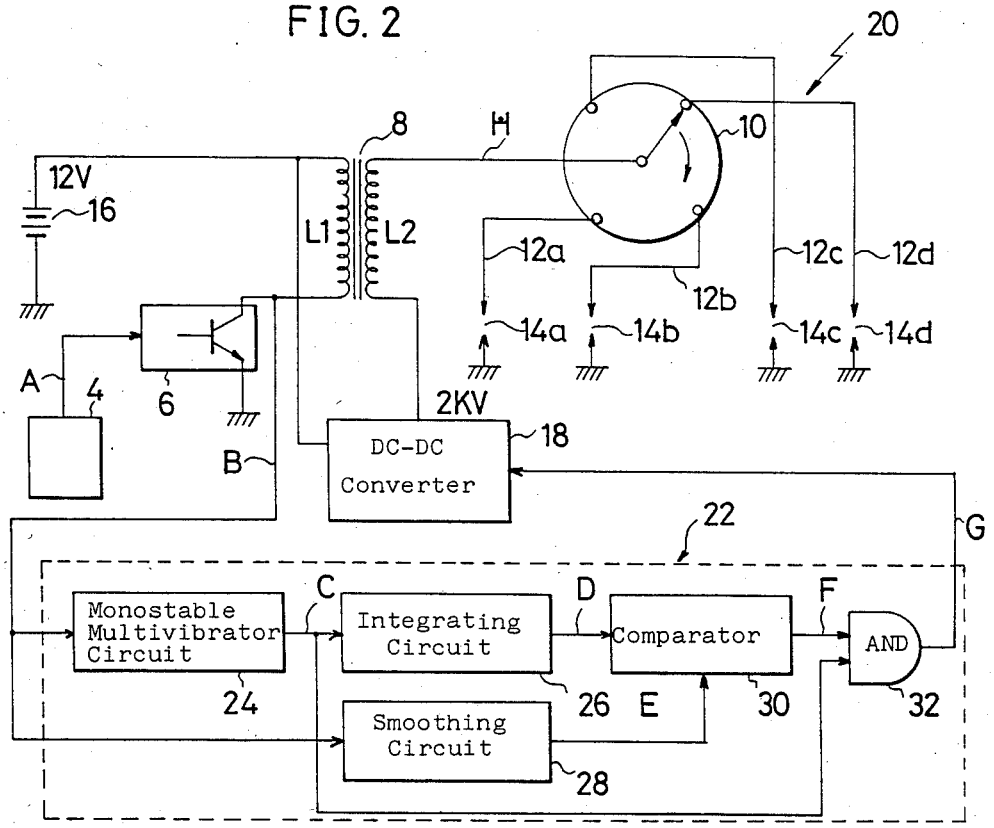
FIG. 2 is a block circuit diagram of one embodiment of the engine ignition circuit in accordance with the present invention.

Referring to FIG. 2, there is shown with reference numeral 20 an embodiment of the engine ignition device in accordance with the present invention. In FIG. 2, identical elements of the device as in the example of the conventional device shown in FIG. 1 are labeled with the same symbols. In this engine ignition device 20, the crank angle sensor 4, the transistor ignition circuit 6, the ignition coil 8, the distributor 10, the high tension cords 12*a*–12*d*, and the ignition plugs 14*a*–14*d* are connected in the same way as in the conventioned device. In the engine ignition device 20 embodying the present invention, there are provided in addition a DC-DC converter controlling circuit 22 to control the initiation time of operation and the operating time of the DC-DC converter 18. The control circuit 22 is constructed with a monostable multivibrator circuit 24, an integrating circuit 26, a smoothing circuit 28, a comparator 30, and an AND circuit 32. The output of the transistor ignition circuit 6 is input to the monostable multivibrator circuit 24 and the smoothing circuit 28. The output of the monostable multivibrator circuit 24 is input to the integrating circuit 26 whose output in turn is input together with the output from the smoothing circuit 28 to the comparator 30. The outputs of the comparator 30 and the monostable multivibrator circuit 24 are input to the AND circuit 32 whose output is then input to the DC-DC converter 18 to control the switching on and off of the converter 18.

Figure 3:
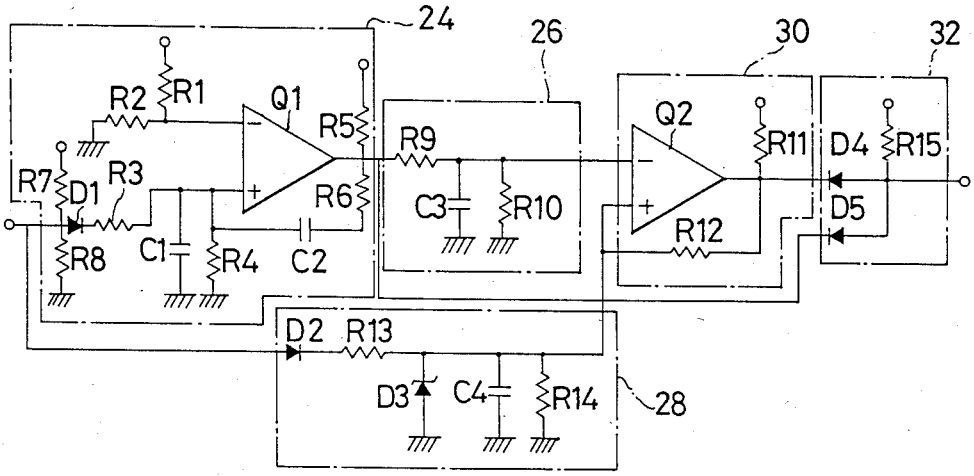
FIG. 3 is a circuit diagram illustrating a concrete example of construction of the control circuit for the DC-DC converter.

FIG. 3 shows a concrete example of the construction of such a DC-DC converter controlling circuit 22. The circuit comprises a monostable multivibrator circuit 24 which consists of an OP amplifier Q1, resistors R1–R8, condensors $C_1$ and $C_2$, and a diode $D_1$, an integrating circuit 26 which consists of resistors R9 and R10, and a condensor $C_3$, a smoothing circuit 28 which consists of diodes $D_2$ and $D_3$, resistors R13 and R14, and a condensor C4, a comparator 30 which consists of an OP amplifier $Q_2$ and resistors R11 and R12, and an AND circuit 32 which consists of diodes $D_4$ and $D_5$, and a resistor R15.

Figure 4:
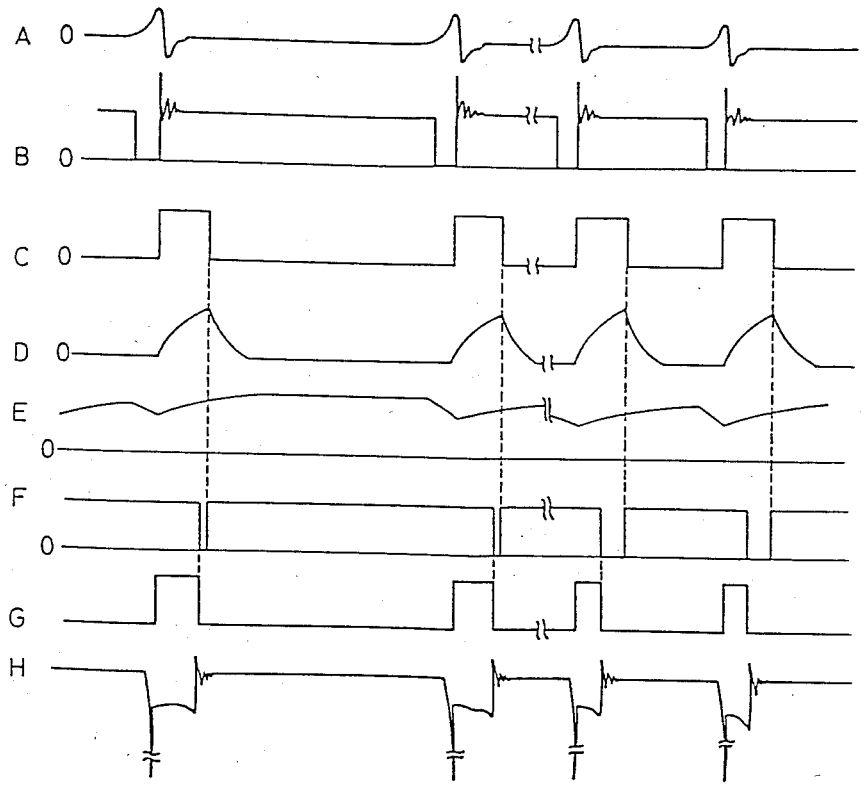
FIG. 4 is a time chart showing the voltage waveform at each point A through H designated in FIG. 2.

The operation of this embodiment will now be illustrated by making reference to the voltage waveforms, shown in FIG. 4, that are generated at points A through H of FIG. 2.

For example, in the case of a four-cylinder engine, upon being input the signal output (A of FIG. 4) from the crank angle sensor 4 that is generated at every 180° of the crank angle, the transistor ignition circuit 6 generates a high tension pulse of order of −15 kV in the secondary windings $L_2$ through switching on and off of the electric current that is supplied by the battery 16 to the primary windings $L_1$ of the ignition coil 8. The discharges start when the high tension pulse is supplied to the ignition plugs 14*a*–14*d* via the distributor 10 and the high tension cords 12*a*–14, and proceed in the same way as it occurs in the conventional device.

On one hand, the DC-DC converter 18 is controlled by the DC-DC converter controlling circuit 22 to function only at times when the signal output from the AND circuit 32 is generated, and stops functioning at other times. To be more precise, the monostable multivibrator circuit 24 is triggered and generates an output for a fixed duration of time (C of FIG. 4) when it receives the primary ignition signal (B of FIG. 4), which is the input from the transistor ignition circuit 6. That output is input to the intergrating circuit 26 which generates an output (D of FIG. 4) whose voltage rises in the course of time. Further, the smoothing circuit 28 generates an output (E of FIG. 4) whose voltage is higher when the engine speed is lower and lower when the engine speed is higher. Since the integrating circuit 26 generates an output which has the same waveform for every ignition, the comparator 30, which receives the output from both the smoothing circuit 28 and the integrating circuit 26, generates a pulsed output (F of FIG. 4) that has a narrower width in the "L" state for higher output voltages of the smoothing circuit 28, that is, for lower engine speed. Therefore, the AND circuit 32, which receives, as its input, both the outputs from the comparator 30 and the monostable multivibrator circuit 24, generates a pulsed output (G of FIG. 4) that rises with the start of the ignition and has a larger width for lower engine speed.

As a result, the DC-DC converter 18 starts operation synchronously with the generation of the output from the AND circuit 32, and generates a high voltage output (H of FIG. 4) of about −2 kV which is the result of boosting the battery voltage of 12 V. This high voltage output is impressed on the ignition plugs 14*a*–14*d* via the secondary windings $L_2$ of the ignition coil 8. Therefore, the discharge in the ignition plugs 14*a*–14*d* initiated by the transistor ignition circuit 6 is augmented by the DC-DC converter 18, is prolonged by an amount corresponding to the operating duration of the converter.

In addition, the discharge duration of the ignition plugs 14*a*–14*d* is shortened as the engine speed is raised since the DC-DC converter functions synchronously with the output of the AND circuit 32, as was mentioned earlier.

Figure 5:
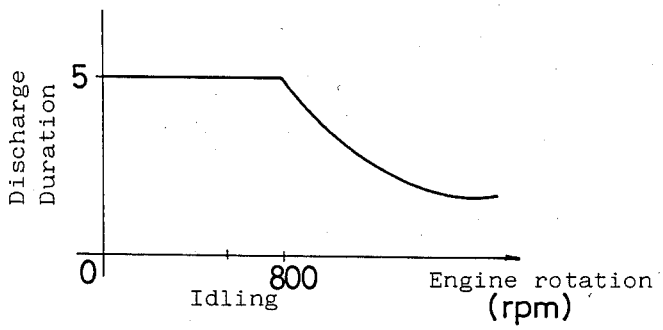
FIG. 5 is a graph illustrating the discharge time characteristic of the engine ignition device shown in FIG. 2.

FIG. 5 shows the discharge duration characteristic of the ignition plugs vs. the engine speed for a device of this embodiment. It is seen that the discharge duration is kept at a constant value of about 5 ms for the range of engine speed from idling to about 800 rpm, and the discharge duration is made to decrease gradually beyond that range. Because of this, the ignition and combustion at the low speed range are insured, and at the same time, wasteful loss of discharge energy at the medium to high speed range is suppressed, making it possible to improve the fuel consumption to the extent possible. In addition, through reduction of the discharge duration, an improvement in the durability of the device can be achieved by suppressing the consumption of the ignition plugs and by reducing the amount of heat generated in the DC-DC converter, the ignition coil, and so forth. Moreover, as the operation of the DC-DC converter prior to the initiation of discharge is suspended it is possible to avoid the engine malfunctioning by eliminating irregular discharges.

It should be mentioned that in order to obtain the above characteristics it is necessary first to arrange, for the low engine speed range below 800 rpm, to have the output voltage of the smoothing circuit 28 to be higher all the time than the output voltage of the integrating circuit 30. Then, it is only necessary to set the output duration of the AND circuit 32 to remain constant and to be identical to the output duration of the monostable multivibrator circuit 24, by maintaining the output voltage of the comparator 30 to stay always in the "H" level.

In summary, according to the present invention, there is provided a DC-DC converter controlling circuit which makes the DC-DC converter to start operation synchronously with the initiation of ignition and reduces the operating time of the converter as the engine speed increases. With this provision, it becomes possible to improve the fuel consumption by saving electric power to the extent possible without impairing the ignition and combustion performances of the engine. In addition, the present invention makes it possible to achieve various excellent effects such as a suppression of consumption of the ignition plug electrodes, an improvement in the durability of the device due to reduction in the amount of generated heat in the DC-DC converter and the ignition coil, an improvement in the engine stability due to prevention of irregular discharges, and the like.

Various modifications will become possible for those skilled in the art after receiving the teachings of the present disclosure without departing from the scope thereof.

What is claimed is:

1. An engine ignition device comprising an ignition coil having primary and secondary windings, an ignition circuit with a switching means for generating a voltage having a high absolute value in the secondary winding of the ignition coil through switching an electric current flowing in the primary winding of the ignition coil by producing a primary ignition signal, a DC-DC converter connected to the secondary winding for boosting and supplying the generated voltage having a high absolute value to ignition plugs to prolong the discharge duration of the ignition plugs, and a DC-DC converter controlling circuit for controlling the DC-DC converter to initiate ignition synchronously with said primary ignition signal and to reduce the operating time of the DC-DC converter as the engine increases its speed, wherein said DC-DC converter controlling circuit comprises:

a smoothing circuit for receiving the primary ignition signal from the switching means and generating an output whose absolute value is higher when the engine speed is lower and lower when the engine speed is higher;

a monostable multivibrator circuit for receiving the primary ignition signal and generating an output having a fixed time duration;

an integrating circuit for receiving the output from the monostable multivibrator circuit;

a comparator for receiving outputs from both the smoothing circuit and the integrating circuit, comparing them with each other and generating an output when the absolute value of the output of the smoothing circuit is higher than that of the output of the integrating circuit; and an AND circuit for producing a pulsed output whose absolute value rises with the start of the ignition and which has a larger width for lower engine speed in response to the outputs from the comparator and the monostable multivibrator circuit, and for transmitting to the DC-DC converter said pulsed output.

2. An engine ignition device as claimed in claim 1, wherein said switching means has a positive terminal and said primary ignition signal is received by said smoothing circuit from said positive terminal.

3. An engine ignition device as claimed in claim 2, wherein said fixed time duration output of said monostable multivibrator circuit is a positive signal.

4. An engine ignition device as claimed in claim 3, wherein said output of said comparator is a positive signal.

* * * * *